United States Patent [19]

Holmgren et al.

[11] Patent Number: 4,489,226

[45] Date of Patent: Dec. 18, 1984

[54] DISTRIBUTION CLASS PUFFER INTERRUPTER

[75] Inventors: Nils V. Holmgren, Greendale; Donald R. Martin, Racine, both of Wis.

[73] Assignee: McGraw-Edison Company, Rolling Meadows, Ill.

[21] Appl. No.: 414,607

[22] Filed: Sep. 3, 1982

[51] Int. Cl.[3] ..... H01H 33/88

[52] U.S. Cl. ..... 200/148 A; 200/150 G

[58] Field of Search ..... 200/148 A, 150 G, 148 R, 200/148 B

[56] References Cited

U.S. PATENT DOCUMENTS

| | | | |
|---|---|---|---|
| 3,214,550 | 10/1965 | Easley | 200/148 A |
| 3,527,912 | 9/1970 | Jaillet | 200/150 G |
| 3,786,215 | 1/1974 | Mauthe | 200/150 G |
| 4,339,641 | 7/1982 | Noeske | 200/148 R |

FOREIGN PATENT DOCUMENTS

| | | | |
|---|---|---|---|
| 2034121 | 5/1980 | United Kingdom | 200/148 B |

*Primary Examiner*—Robert S. Macon

*Attorney, Agent, or Firm*—Jon Carl Gealow; James A. Gabala; Hugh M. Gilroy

[57] ABSTRACT

An interrupter is provided having: an outer enclosure or tank adapted to contain an arc-extinguishing fluid; a fixed tubular electrical current carrying member disposed at one end of the tank; a movable tubular current carrying member disposed in the tank in an end-to-end relationship with the fixed electrical current member; a prime mover for stroking the movable current carrying member between an open position and a closed position; an electrically conductive piston means, carried by the movable electrical current carrying member, for supplying pressurized fluid into the gap formed between two current carrying members when the interrupter is opened and for purging the vicinity of the gap when the interrupter is closed; a non-electrically conductive base means, carried by the outer enclosure, for housing the piston means and for guiding the movement or the stroking of the movable current carrying member; and an insulated plenum means, carried by the piston means and disposed around the contacting ends of the two current carrying members, for confining the flow of pressurized arc-extinguishing fluid into the gap formed between the two current carrying members when the interrupter is opened so as to direct ionized fluid and arc by-products away from the interior surfaces of the outer enclosure and to shield the operating components within the interrupter from direct blast of arc by-products released by the arc.

15 Claims, 5 Drawing Figures

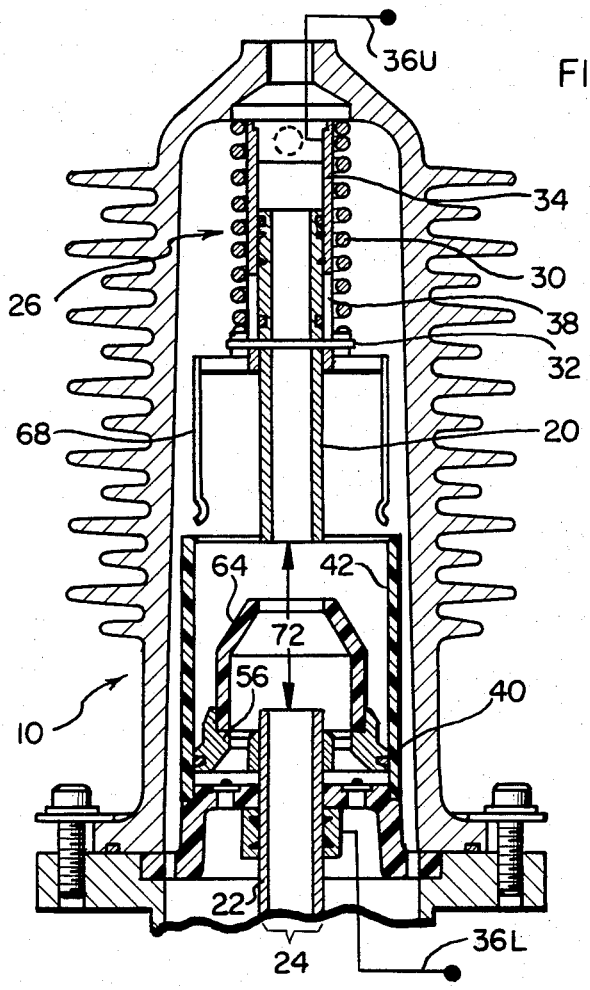
FIG. 4
FIG. 5
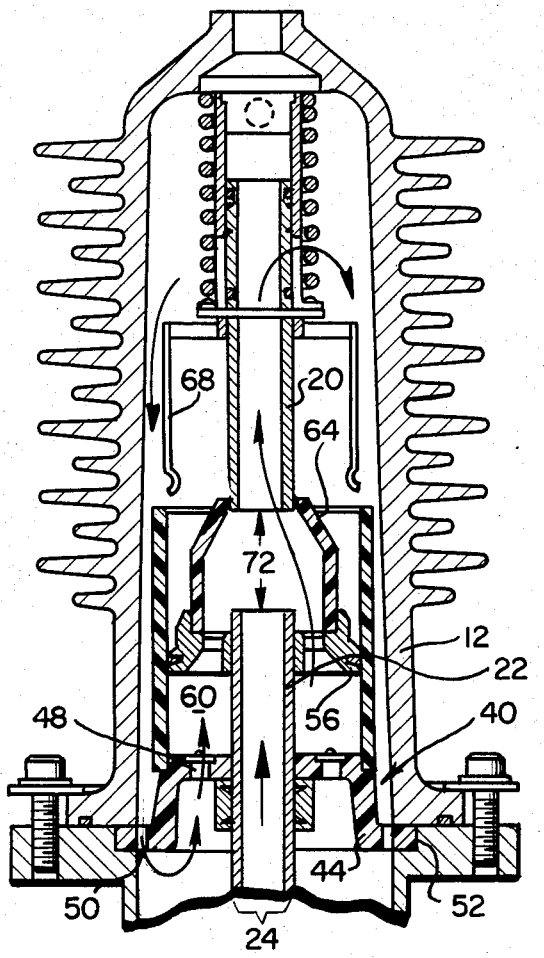

DISTRIBUTION CLASS PUFFER INTERRUPTER

TECHNICAL FIELD

This invention relates in general to circuit interrupters and more particularly to fluid-blast circuit interrupters of the puffer type.

BACKGROUND OF THE INVENTION

Puffer interrupters have enjoyed ever increasing commercial success. This is due in part to their simple construction and excellent service record. The increased use of puffer interrupters in power class circuit breakers has been at the expense of the more complex two-pressure interrupters. Unfortunately, compared to a two-pressure interrupter, a puffer interrupter requires a relatively large prime mover.

The prime mover of a power class interrupter is a small part of the total cost of the interrupter relative to the cost of a prime mover in a distribution class or subtransmission class breaker or interrupter. Therefore, the design and cost of a relatively large prime mover impacts the cost of a power class circuit breaker to a lesser extent than a distribution or subtransmission class breaker. If one were to design a distribution class breaker or recloser using the puffer interrupter concept, the designer must therefore endeavor to minimize the energy consumed by the prime mover in operating the breaker.

The breaking process is characterized by an arc appearing for a limited period of time across the gap between the opening contacts of the breaker. See *TRV and Interrupter Interaction, Parts I and II*), by N. Holmgren, "The Line", Volume 78/4 and 79/1). This arc plasma column imposes severe environmental conditions on the components of the interrupter; for example:

a. the arc plasma has a temperature exceeding 20,000 degrees Kelvin;

b. the turbulent supersonic flow of the quenching gas in a changing flow geometry ranges from a few hundred meters per second to several thousand meters per second; and c. the voltage and gradient placed upon the components in the vicinity of the arc is large (e.g. 10 KV/cm.)

Immediately after the current passes through a current zero, the critical stress is dependent upon the rate at which the recovery voltage rises. This rate is relatively high following a short-line fault (e.g. 2–7 Kv/μsec). Those points at which the arc roots are located after contact separation are particularly high stressed and in addition are contaminated with metalic vapor and ionized fluid. Typically, these arc by-products are deionized and removed by a concentrated gas blast in the vicinity of the arc. Because the gap region is open to the interior surface of the interrupter housing, part of the arc by-products are dissipated to the surrounding gas, while the majority is drawn through the tubes or hollow contact elements of the puffer.

Normally, the nozzle surfaces across which the arc is formed "ablate" during the interruption process. As a nozzle ablates, its dimensions change and the arc geometry is effected. Ultimately, with the deterioration of the nozzle surfaces, the interruption rating of the device will be effected. Thus, the service life of a puffer interrupter will be increased by having components in the vicinity of the arc that effect the geometry or the flow of arc extinguishing fluid resistant to ablation by the arc.

In addition to the ablation problem, those skilled in the art known that materials in the gap having a dielectric constant different from that of the gas or arc extinguishing fluid cause a distortion in the surrounding potential field. This distortion can cause high-voltage stresses to appear across the gap. These high-voltage stresses, in turn, can initiate a flash over of the contacts while they are separated or when the interrupter is opened.

If the materials having a different dielectric constant (i.e., so called "shunting dielectrics") are removed, a more uniform potential field is created in the vicinity of the gap. This in turn would reduce the voltage stress and decrease the possibility of a flashover. In this context "shunting dielectrics" include such materials as TEFLON (polytetrafluoroethylene) which have a dielectric constant significantly different from that of the quenching gas (i.e., typically, sulphurhexafluoride $SF_6$).

Areas of low dielectric strength can also be reduced by increasing the circulation of gas within the interrupter. Increased gas circulation would prevent stagnant gas (i.e., the gas most recently involved in the interruption process) from remaining concentrated in any one particular area of the interrupter. Circulation would provide a "mixing action" which would insure that the arc extinguishing gas has a more uniform dielectric strength throughout the interior of the interrupter. The gas most recently involved in the interruption process has a lower overall dielectric strength. Therefore, it is important to insure that gas having a relatively low dielectric strength does not build up in regions such as that surrounding the open contact gap and any point where a significant voltage stress exists between the current carrying parts of the interrupter and the ground. Critical insulating surfaces are those insulating surfaces in close proximity to the arc blast. Thus, if these surfaces are shielded from the arc, the fall out of arc products is minimized and the surrounding insulating surfaces can withstand the high-intensity radiation from the arc without the danger of a restrike or flashover.

Other inventors have recognized the problems associated with the interruption process; few however have proposed an apparatus that efficiently and economically resolves the problem of voltage stress and gas circulation. Hanke (in U.S. Pat. No. 4,146,763) employed an annular electrode positioned adjacent the end portion of the blasting cylinder in a puffer interrupter to act as a collecting electrode to "even-out" the charge distribution on the blasting cylinder. Fischer (in U.S. Pat. No. 4,249,049) disclosed a plane break circuit interrupter incorporating a set of moving and stationary contact shields which surround the main contacts of the interrupter. This arrangement is thought to prevent the formation of critical points of dielectric stress, both during the opening and the closing cycle of the interrupter. Thus, when closing, pre-strike should be prevented and when opening restrike and reignition should be prevented. Finally, Gonek (in U.S. Pat. No. 4,086,461) uses an external moveable bridging contact comprising an open-ended, cylindrical sleeve of electrically-conductive material to direct the flow of arc extinguishing gas and to improve the dielectric withstand to high-voltage (i.e., switching and lightning overvoltages).

For the most part, each of these earlier designs is relatively complicated, requires extensive mechanical linkages and connections, and is expensive to manufacture and maintain in operation once it is put in use. It is especially significant that no one has thought of confining the arc extinguishing process within a plenum or chamber separately disposed from the housing which encloses the interrupter.

An inexpensive, relatively simple, innovative design for a small compact buffer interrupter of the subtransmission or distribution class variety would be a welcome addition to the art. This would be particularly true if the design incorporated features which would reduce maintenance and operating costs.

SUMMARY OF THE INVENTION

In accordance with the present invention, an interrupter is provided having: an outer enclosure or tank adapted to contain an arc-extinguishing fluid; a fixed electrical current carrying member, carried within the tank; a moveable current carrying member disposed in the tank in an end-to-end relationship with the fixed electrical current carrying member; a prime mover for stroking the moveable current carrying member between an open position and a closed position; an electrically conductive piston means, carried by the movable electrical current carrying member, for supplying pressurized fluid into the gap formed between the two current carrying members when the interrupter is opened; a non-electrically conductive base means carried by the outer enclosure for housing the piston means and guiding the movement or the stroking of the moveable current carrying member; and an insulated plenum means, carried by the piston means and disposed around the contacting ends of the two current carrying members, for confining the flow of pressurized arc-extinguishing fluid into the gap formed between the two current carrying members when the interrupter is opened. Preferably, each current carrying member defines an internal passageway in fluid communication with the gap across which the arc is formed. This passageway directs ionized fluid away from the gap and minimizes the discharge of arc by-products away from the arc and towards the interior surfaces of the outer enclosure. The piston means and the base means together form a variable volume chamber whose interior is pressurized when the prime mover strokes the moveable contact member from its closed position to its open position. Preferably, the plenum means has an axial length at least equal to the length of the arc formed between the electrical current carrying members that form the gap. This arrangement shields the radially disposed, adjacent interior surfaces of the outer enclosure from the ionized fluid and arc by-products products formed across the gap when the interrupter is opened.

In the prefered embodiment, the current carrying members are tubular and non-ablative having complementary abutting ends such that when the interrupter is closed, fluid communication from the interior to the exterior of the tubular members is shut off at the abutting ends. In addition, the base means carrys one or more check valves disposed between the variable volume chamber and the interior of the outer enclosure. The pressure developed within the variable volume chamber caused by the stroking of the piston means with the prime mover forces the check valve shut; the pressure reduction within the variable volume chamber caused by the stroking of the piston means with the prime mover in shutting or closing the interrupter has the effect of opening the check valve and drawing arc-extinguishing gas into the variable volume chamber, thereby replenishing the variable volume chamber in anticipation of opening the interrupter.

In one embodiment, the base means defines a cylinder which is opened at one end and which is adapted to receive a piston. The cylinder has an axial length greater than the axial length of the plenum means such that the open end of the cylinder extends beyond the plenum means when the interrupter is open. Thus, the cylinder also shields the interior surface of the outer enclosure from the arc products formed when the interrupter is opened. Preferably, the base means includes a current interchange means for electrically connecting the moving current carrying member to an external electrical circuit. Preferably, at least one of the plenum means and the cylinder portion of the base means is radially disposed between the gap and the interior surface of the outer enclosure in the vicinity of the arc throughout the opening stroke of the interrupter.

In one embodiment, the plenum means is connected to the piston in such a manner that a plurality of passageways is defined between the variable volume chamber and the open end of the plenum means. The plenum means, as such, defines a tubular nozzle, which is connected to the piston and disposed around the exterior of the fixed current carrying member when the interrupter is closed so as to define a flow restrictive annular opening. Thus, when the interrupter is opened, the fluid is discharged from the variable volume chamber and along the exterior of the arc formed between the two current carrying members until the fixed current carrying member passes beyond the open end of the nozzle.

In one embodiment, the interrupter is provided with a lost motion means and a set of contactors in the form of sliding fingers. These sliding fingers are radially disposed around the plenum means and mate with the piston means when the interrupter is closed. The lost motion means maintains the fixed current carrying member in an abutting relationship with the moving current carrying member until the piston means and the sliding fingers have been separated from each other. Under this arrangement, electrical current flowing through the sliding fingers is shut off before the two current carrying members separate to form the arc. Thus, the arc is confined at the interior of the plenum means. The plenum means thereby shields the mating ends of the sliding fingers from the arc by-products.

From the foregoing description, it should be clear that since the arc is confined within the plenum means, the entire low pressure volume, or the volume of arc-extinguishing fluid at the exterior of the plenum means, is not diluted with gas having a lower dielectric strength. By requiring the arc extinguishing gas discharged from the variable volume chamber to flow toward the interior of the current carrying members, the pressure between the outer enclosure and the exterior of the plenum means is kept relatively low. This improves the mass flow rate of gas through the current carrying members. In addition, since the interruption process is confined within the interior of the plenum, and since ablative nozzles are preferrably not employed, arc by-products are not discharged so as to increase the back pressure thereby reducing the energy requirements of the prime mover. Moreover, since material is not ablated, critical parts do not wear out and the effective duty cycle or operating life of the interrupter is increased. Finally, since the plenum means acts as a shield, the surrounding insulating surfaces of the tank or the enclosure are not exposed to high-intensity radiation. This improves the safety of operating personnel from the dangers of an internal fault. It also improves the reliability of the interrupter.

Those skilled in the art will understand from the detailed description following that the interrupter just described features an arrangement wherein the moving parts are kept to a minimum and relatively low pressure is required to achieve interruption. Moreover, the interrupter exhibits extended life by employing a non-ablative nozzle. The interrupter is also designed to expose the downstream side of the gas flow nozzle to a lower downstream pressure; this is achieved by effectively allowing the downstream volume to be fully utilized. Pumping action is used to recirculate the gas and to prevent refilling the puffer cylinder with gas that was recently used to achieve interruption. Finally, an insulating plenum is employed to contain the interruption process thereby preventing deterioration of adjacent insulated parts as a result of being exposed to the arc by-products once an arc is produced.

Numerous other advantages and features of the present invention will become readily apparent in the following detailed description of the invention and the embodiments described therein, from the claims, and from the accompanying drawings.

BRIEF DESCRIPTION OF THE DRAWINGS

FIG. 4 is a view of the puffer interrupter shown in FIG. 1 in the fully opened position; and FIG. 5 is a view of the puffer interrupter shown in FIG. 1, illustrating the relationship of the components when the interrupter is moved from the fully opened position to the closed position.

DETAILED DESCRIPTION OF THE PREFERRED EMBODIMENTS

Figure 1:
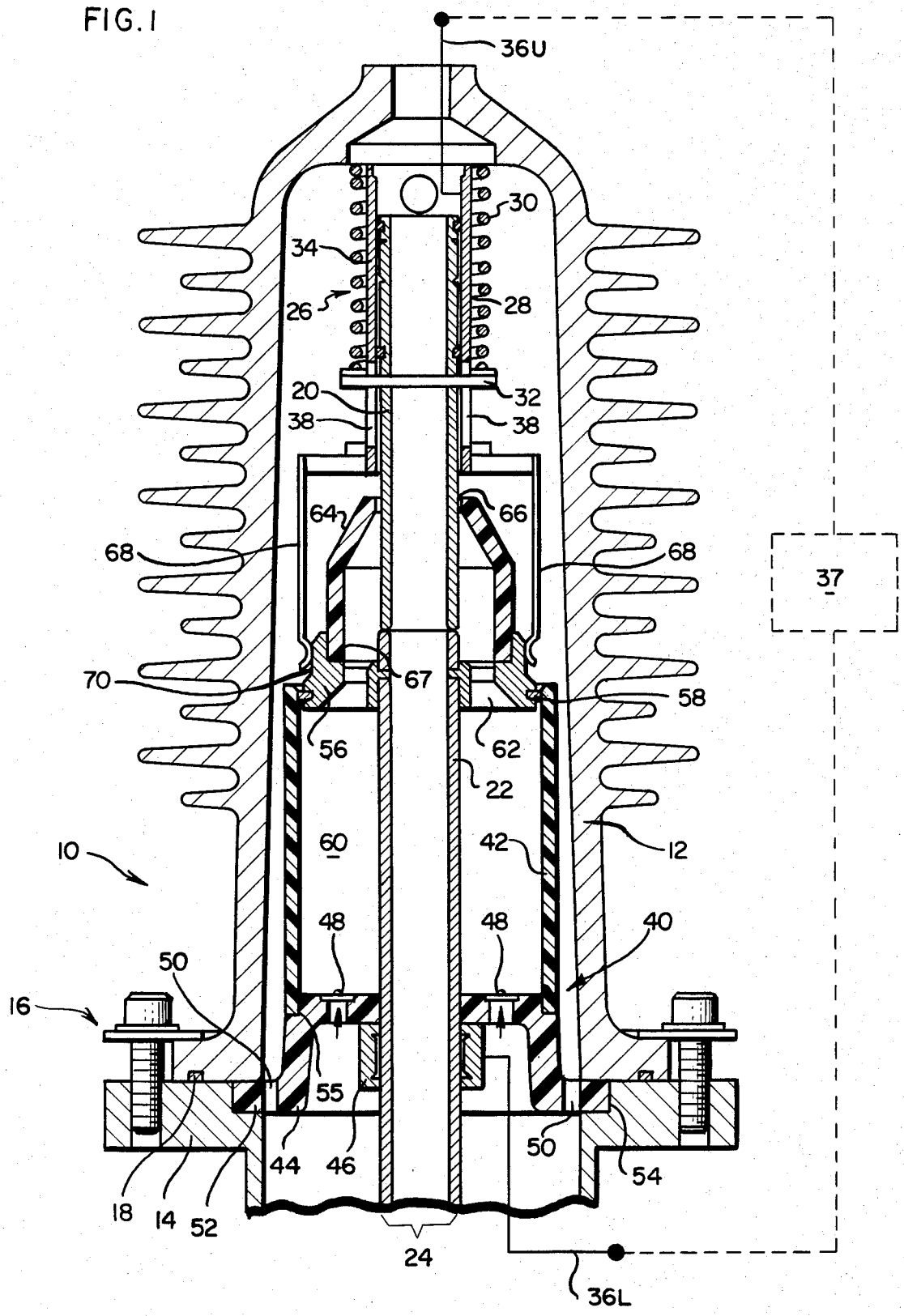
FIG. 1 is a cross-sectional, elevational view of the puffer interrupter that is the subject of the present invention with the interrupter in the closed or shut position.

While this invention is susceptible to embodiment in many different forms, there is shown in the drawings and will herein be described in detail one specific embodiment with the understanding that the present disclosure is to be considered as an exemplification of the principles of the invention and is not intended to limit the invention to the specific embodiment illustrated.

For ease of description, the interrupter that is the subject of this invention will be described in one particular orientation or in the orientation illustrated in the drawings and the terms "upper", "lower", etc., will be used with reference to this position. It will be understood however, that the apparatus of the invention may be manufactured, stored, transported, and sold in orientations other than that illustrated.

COMPONENTS

For purposes of general orientation, the principal components of the invention will be identified with reference to FIG. 1. After all of the major components have been described, the operation of device will be described with reference to FIGS. 2 through 5. Referring to FIG. 1, the operating components of the puffer interrupter 10 are housed within an outer enclosure 12 which is adapted to contain therein an arc-extinguishing gas such as sulphurhexafluoride ($SF_6$). The lower end of the outer enclosure is disposed atop a base member 14; a bolting ring 16 is used to clamp the outer enclosure 12 to the base member 14. Suitable sealing components such as an O-ring 18, are used to provide a pressure seal between the interior of the outer enclosure 12 and the surrounding environment.

The outer enclosure 12 houses two electrical current carrying members or contacts 20 and 22. These two current carrying members are generally tubular in shape and are co-axially disposed relative to one another. One current carrying member 20 (i.e., the uppermost of the two using the orientation of the drawings is essentially fixed in position while the other current carrying member 22, the lower one, is mounted so as to be movable (i.e., raised and lowered) towards and away from the upper current carrying member. The lower current carrying member 22 is moved towards and away from the upper current carrying member 20 by a prime mover 24. When the lower current carrying member 22 is fully raised, the upper and lower current carrying members come into contact with each other in an abutting relationship such that a good electrical current flow path is formed while a pressure and fluid seal is formed between the interior and the exterior of the two members at their abutting ends. In this configuration, the interrupter 10 is in its "closed position". When the upper and lower current carrying members 20 and 22 are fully spaced apart from each other so as to define a gap 72 (see FIG. 4), the interrupter is in its fully "opened position".

Turning now to the upper current carrying member 20, a lost motion means 26 is used to support the tubular current carrying member at the upper end of the outer enclosure 12. In the embodiment illustrated, the support arrangement or the lost motion means 26, is much as that illustrated in U.S. Pat. No. 4,112,276. Here the lost motion means 26 includes: a stationary sleeve 28; a biasing means 30; a stop 32; and a current interchange 34. The upper end of the stationary sleeve 28, using the orientation in FIG. 1, is connected to the upper end of the outer enclosure 12. The upper current carrying member 20 fits within the sleeve such that it is free to move towards and away from the upper end of the lower current carrying member 22. The current interchange 34, is used to electrically connect the stationary sleeve 28 with the upper current carrying member 20. The stationary sleeve in turn is provided with a suitable connection means 36U to electrically connect the stationary sleeve 28 with the external electrical circuit 37 across which the interrupter is interposed. In the arrangement shown in FIG. 1, the lower end of the stationary sleeve 28 is provided with two longitudinal slots or slits 38. The stop 32, connected to the upper current carrying member 20 and fitting within two slots, is used to couple the upper current carrying member to the stationary sleeve 28. The vertical travel of the upper current carrying member 20 within the stationary sleeve 28 is limited by or is determined by the vertical length of the two slots 38. Here the biasing means 30 is a coil spring disposed between the stop 32 and the outer enclosure 12. As shown in the drawings, the biasing means 30 effectively biases the upper current carrying member 20 towards the lower current carrying member 22. The purpose and utility of this arrangement will be described in short order.

Turning now to the lower end of the outer enclosure 12, the lower current carrying member 22 is axially guided towards and away from the upper current carrying member 20 by an insulated or non-conductive base means 40. The base means 40 includes: a generally cylindrical portion 42; an insulated base member 44; a current interchange 46; and one or more check valves 48.

The insulated base member 44 is that component of the base means 40 to which the remaining elements or components are connected. The base member 44 is carried by the interrupter base 14. As illustrated in the drawings base member 44 is generally cylindrical in shape having a central opening into which the lower current carrying member 22 is radially located. The base member 44 defines a circular flange or rim portion 52. This rim or flange portion 52 fits within a channel 54 defined within the interrupter base 14. Thus, the base means 40 has a shape resembling that of a "top hat". Openings 50 within the flange portion 52 of the base member 44 are provided to allow the free flow of gas from one side of the base means 40 to the other.

The base member 44 supports the current interchange 46 which electrically connects the lower current carrying member 22 with one end 36L of the external electrical circuit 37. The upper end of the base member 44 preferrably carries a plurality of check valves 48 which are used to control the flow of gas into the interior of the cylindrical portion 42. The upper end of the base member 44 is also provided with a slot or recess 55 into which is fitted the cylindrical portion 42 of the base means 40. Although not shown in the drawings for purposes of clarity a suitable pressure seal is provided between the base member 44 and the lower current carrying member 22 such that a pressure seal is formed.

The upper end of the lower current carrying member 22 carries an electrically conductive piston means 56. The periphery of the piston means 56 is provided with a suitable sealing member, such as a piston ring 58, to form a pressure seal between the interior of the cylindrical portion 42 of the base means 40 and the piston means 56. Thus, the base means 40 and the piston means 56 define a variable volume chamber 60, the volume of which is dependent upon the position of the piston means 56 or the stroking of the lower current carrying member 22 by the prime mover 24. The piston means 56 defines one or more flow channels or interior openings 62. These channels 62 allow the gas within the variable volume chamber 60, which is compressed by the piston means 56 when the lower current carrying member 22 is forced downwardly by the prime mover 24, to flow towards the upper current carrying member 20.

The piston means 56 carries an insulated electrically non-conductive enclosure or plenum 64. The plenum 64 confines the gas flowing out of the variable volume chamber 60 to the vicinity of the abutting ends of the two current carrying members 20 and 22. A relatively small annular opening 66 is defined by the exterior of the upper current carrying member 20 and the upper end of the plenum 64. As illustrated in the drawings, the lower end of the plenum is fitted within a groove 67, defined at the upper end of the piston means 56.

By forming the base means 40 from an insulating material, separate insulators are not required to support and insulate the current carrying members of the interrupter 10. The base means-40 can be molded from insulating material such as a cycloaliphatic or bisphenol-A epoxy resin. Thus, the base means 40 functions as the cylinder portion of a piston and cylinder puffer interrupter, guides and supports the moving current carrying members (i.e., the piston means 56 and the lower current carrying member 22), and provides the main insulating support for the puffer interrupter structure housed within the outer enclosure.

Returning to the upper end of the outer enclosure 12, the lower end of the stationary sleeve 28 is provided with a plurality of sliding fingers 68. These sliding fingers are used to electrically connect one end 36U of the external electrical circuit 37 with the piston means 56 when the interrupter 10 is closed. Since the piston means 56 is electrically conductive and is carried by the lower current carrying member 22, the two ends 36U and 36L of the external electrical circuit 37 are connected together when the interrupter is closed by the current flow path defined by: (1) the sliding fingers 68 and piston means 56; and (2) the two abutting ends of the upper and lower current carrying members 20 and 22.

The following materials are suggested. The upper current interchange 34 and the sliding fingers 68 are preferably formed from a beryllium copper alloy. The stationary sleeve 28, the piston means 56, the lower current interchange 46, and the lower current carrying member 22 are preferably formed from a good electrical current carrying material such as copper. The upper current carrying member 20 is preferably formed from copper or a copper alloy. The plenum 64 is preferably formed from a silica filled Teflon material. Finally, stainless steel check valves 48 are preferred since stainless steel possesses good corrosion resistance properties in a puffer interrupter having $SF_6$ as the arc extinguishing fluid. Other materials may of course be used and are well within the knowledge of those skilled in the art.

OPERATION

Now that the principal components of the interrupter 10 have been identified, the integrated operation of the interrupter 10 will be explained. To interrupt the current flowing through the external electrical circuit 37 across which the interrupter 10 is imposed, the prime mover 24 is operated to stroke the lower current carrying member 22 downwardly. Since the piston means 56 is coupled to the lower current carrying member 22, the gas within the variable volume chamber 60 is compressed. Initially, the upper current carrying member 20 moves in unison with the lower current carrying member 22. In other words, the two current carrying members remain in an abutting relationship at the beginning of the opening stroke of the prime mover 24. The gas compressed within the variable volume chamber 60 flows across the faces of the piston means 56 through the flow channels 62. Since the two current carrying members 20 and 22 are still in an abutting relationship, the pressure of the gas within the plenum 64 increases. Only a small amount of compressed gas leaks through the annular opening 66 at the upper end of the plenum 64.

As the lower current carrying member 22 moves downwardly, the sliding fingers 68 separate from the associated mating surface 70 on the piston means 56. Since the two current carrying members 20 and 22 are still in an abutting relationship, the electrical current flowing through the associated external circuit 37 now flows across the contacting or abutting ends of the two current carrying members. In other words, the total flow of electrical current through the interrupter 10 now is shifted to a current flow path disposed within the interior of the plenum 64. It should be clear that the length of the slots 38 on the stationary sleeve 28 is selected such that the sliding fingers 68 separate from the piston means 56 before the stop 32 reaches the end of its travel. In other words, since the sliding fingers 68 are connected to stationary sleeve 28, and since the lower current carrying member 22 is connected to the piston means 56, the upper current carrying member 20 must be free to move downwardly in an abutting relationship with the lower current carrying member until some time/distance after sliding fingers have separated from the piston means.

Figure 2:
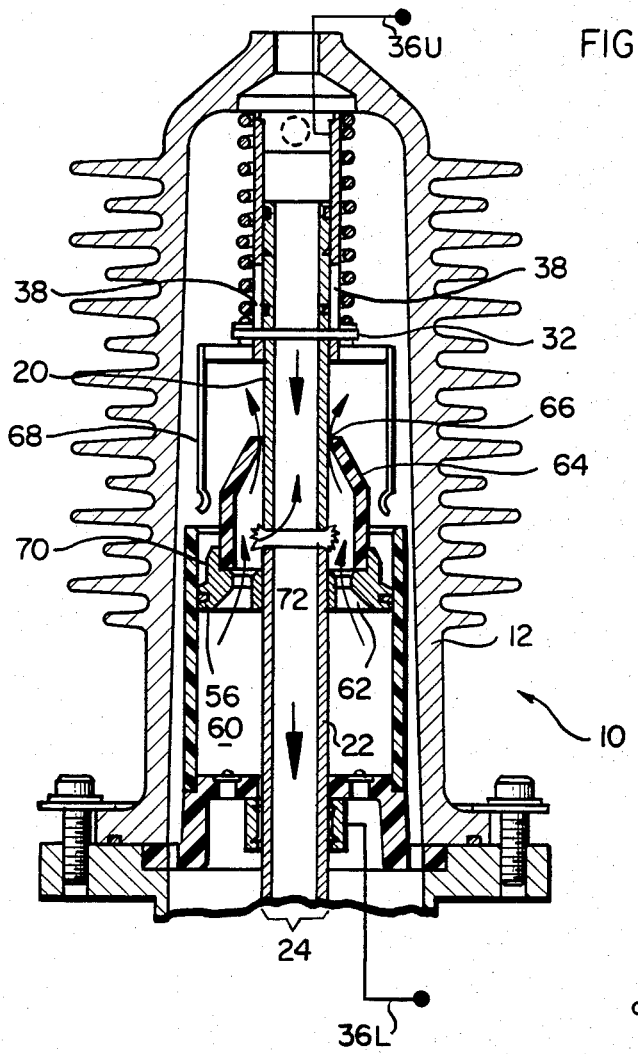
FIG. 2 is a view of the buffer interrupter shown in FIG. 1 just after the two current carrying members have separated.

Once the upper current carrying member 20 has reached the end of its travel within the stationary sleeve 28, it is held fixed in position by the biasing means 30 (i.e. See FIG. 2). Further downward movement of the lower current carrying member 22 causes a gap 72 to form between the two adjacent ends of the upper and lower current carrying members 20 and 22. Since all of the current flowing through the interrupter 10 was flowing across the abutting ends of the two current carrying members, an electrical arc is formed across the gap 72. For this reason, the two current carrying members can also be thought of or referred to as "arcing probes". The gas within the plenum 64 was heretofore prevented from entering the interior of the arcing probes by virtue of their abutting relationship. Once the two arcing probes separate, the gas compressed within the variable volume chamber 60 is now free to enter the interior of the arcing probes. As in the case of conventional puffer interrupters, at current zero, the arc will be extinguished and the flow of current through the external circuit 37 will be interrupted. Preferably, this will occur when the two current carrying members 20 and 22 have been separated by at least one half of one inch (i.e. when a gap 72 of one half inch or more is formed).

Figure 3:
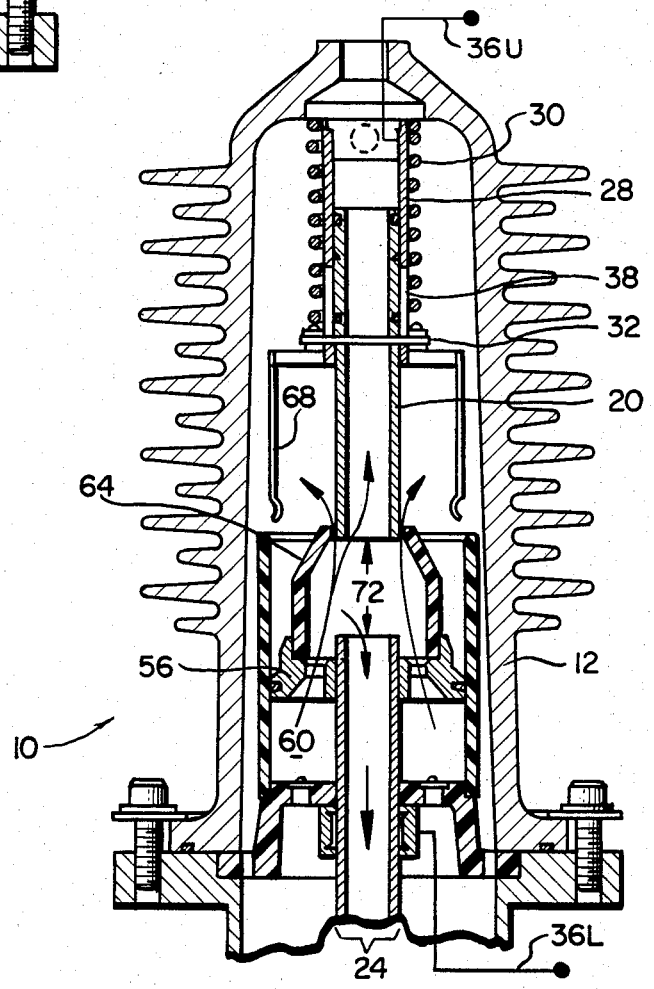
FIG. 3 is a view of the puffer interrupter shown in FIG. 1 just before the fixed current carrying member passes beyond the open end of the plenum means.

Referring to FIG. 3, once the arc between the two current carrying members 20 and 22 has been extinguished, the continued downward travel of the piston means 56 provides a flow of relatively cool gas into the interior of the arcing probes. This is because the lower end of the upper current carrying member 20 is still confined within the plenum 64.

Eventually, the point will be reached (see FIG. 4) where the lower end of the upper current carrying member 20 is withdrawn from the upper end of the plenum 64. Preferably, the length of the cylindrical portion 42 of the base means 40 is selected such that, when the piston means 56 reaches the end of its downward stroke, the gap 72 between the two current carrying members or arcing probes 20 and 22 is confined within the interior of the cylindrical portion. The advantage of this arrangement is that it removes materials of different dielectric constant (i.e., so called "shunting dielectrics") and causes a relatively uniform potential field across the gap 72. This in turn reduces the voltage stress and decreases the possibility of a flashover. Those skilled in the art know that materials in the gap having a dielectric constant different from that of the arc extinguishing gas (e.g. the $SF_6$ fluid) cause the potential field in that vicinity to be distorted. This distortion could cause high-voltage stresses to appear across the gap; these high-voltage stresses, in turn, could initiate a flashover or arc restrike while the interrupter 10 is open. Thus, the efficiency of the present design should be evident.

The closing operation of the interrupter 10 will now be described using FIG. 5. To close the interrupter 10, the prime mover 24 is operated to stroke the lower current carrying member 22 and the piston means 56 upwardly. The upward movement of the piston means 56 causes a partial vacuum or pressure reduction in the variable volume chamber 60. This, in turn, forces the check valves 48 to open which draws arc extinguishing fluid (see flow arrows in FIG. 5) from the upper end of the outer enclosure 12 to the lower end of the base means 40 via the openings 50 in the flange portion 52 of the base member 44. Once the lower end of the upper current carrying member 20 enters the upper end of the plenum 64, the volume at the interior of the plenum 64 between the two ends of the current carrying members is effectively purged by the fluid flowing out of the upper end of the outer enclosure 12 and into the lower end of the base means 40. This flow pattern or circulation of arc extinguishing fluid prevents the build-up of stagnant gas (i.e., that gas which was most recently involved in the interruption process) or concentration of arc extinguishing fluid in any one particular area of the interrupter. In other words, the circulation created by stroking the piston means 56 upwardly provides a mixing action which assures that the arc extinguishing fluid has a relatively uniform dielectric strength throughout the interior of the outer enclosure 12.

Further upward movement of the piston means 56 eventually results in the two current carrying members making contact with each other, thus completing a current flow path to the external electrical circuit 37. Continued upward movement of the lower current carrying member 22 forces the upper current carrying member to move upwardly in opposition to the biasing means 30. Eventually, the lower end of the sliding fingers 68 will make contact with a mating surface 70 on the piston means 56.

It should be appreciated that the prime mover 24 is preferably designed to stroke the interrupter shut at a relatively high rate of speed and that the biasing means 30 acts to retard the upward movement of the lower current carrying member 22 at the end of its closing stroke. Effectively, the biasing means 30 dampens and deaccelerates the moving components of the interrupter 10 when the interrupter is closed. Furthermore, once the biasing means 30 is compressed, energy is stored, which effectively facilitates the separation of the two current carrying members once the prime mover 24 is triggered to drive the lower current carrying member 22 downwardly.

It should also be appreciated that the interrupter just described confines the arc interrupting process within the insulated plenum 64. This is contrary to the usual design of puffer interrupters wherein an ablative nozzle is employed. In a puffer interrupter having a nozzle which ablates, the dimensions of the nozzle change during each interruptions process. Ultimately, the point is reached wherein the device would fail to meet its interruption ratings. In this design, since nozzle material is not ablated, critical parts do not wear out and the effective duty cycle of the device is increased. Moreover, since material does not ablate, the back pressure is minimized and the energy required by the prime mover in operating the device is reduced.

Finally, it should be appreciated that the plenum 64 shields the surrounding insulating surfaces from direct exposure to the arc and the associated arc by-products. Thus, the materials in the vicinity of the gap, and particularly the outer enclosure 12, need not be formed from materials which can tolerate high intensity radiation or the fallout from arc by-products. This simplifies the manufacture of the device and lowers its overall cost.

From the foregoing, it will be observed that numerous variations and modifications may be effected without departing from the true spirit and scope of the novel concept of the invention. For example, although cylindrical geometry has been used in illustrating the invention other shapes and orientations may be used. It should be understood that no limitation with respect to the specific apparatus illustrated herein is intended or should be inferred. It is, of course, intended to cover by the appended claims, all such modifications as fall within the scope of the claims.

What is claimed is as follows:

1. A distribution class interrupter, comprising:

a. an outer enclosure adapted to contain an arc extinguishing fluid therein;

b. a first elongated electrical current carrying member carried within said enclosure;

c. a second elongated current carrying member which is disposed end-to-end with said first member and which is movable within said enclosure between a closed position where it is in electrical contact with said first member and an opened position where it is spaced from said first member, said first member and said second member defining a gap when said second member is in its opened position such that an electrical arc is formed across said gap as said first member is separated from said second member, at least one of said first and second current carrying members defining an internal passageway in fluid communication with said gap and the interior of said enclosure for directing ioized fluid thereformed, said second member being adapted to be operated by a prime mover to stroke said second member between its opened position and its closed position;

d. piston means, carried by said second member, for supplying pressurized fluid into said gap as said second member is moved into its opened position, said pistion means moving between a raised position and a lowered position in response to said prime mover;

e. base means, carried by said outer enclosure, for housing said piston means, said piston means and said base means defining a variable volume chamber whose interior is pressurized when said prime mover strokes said second member for its closed position to its opened position; and f. insulated plenum means, carried by said piston means and disposed around the contacting ends of said first member and said second member, for confining the fluid supplied by said piston means from said variable volume chamber in the vicinity of said gap until said arc is extinguished, said plenum means having a length at least equal to the length of the arc formed between said first and second members, whereby the interior of said outer enclosure adjacent said gap is shielded from the ionized fluid thereformed.

2. A distribution class interrupter, comprising:

a. an outer enclosure filled with an arc extinguishing gas;

b. a first electrical contact having one end disposed towards the interior of said enclosure;

c. a second electrical contact which is movable between a closed position, where one end of said second electrical contact is in an abutting relationship with said one end of said first electrical contact, and a opened position where the abutting ends are spaced from each other, the abutting ends of said first electrical contact and said second electrical contact defining a gap when said second electrical contact is in its opened position, at least one of said first and second electrical contacts defining an axially disposed interior channel through which gas is free to flow from the vicinity of said gap to the interior of said enclosure by virtue of a pressure differential;

d. a prime mover for moving said second electrical contact between its opened and closed positions;

e. an electrically conductive piston carried by said second electrical contact, said piston defining a fluid orifice for ducting fluid through said piston as said piston moves between a raised and a lowered position in response to said prime mover;

f. contactor means, carried by said first electrical contact and mating with said piston, for conducting electrical current from said first electrical contact to said second electrical contact when said piston is in its raised position;

g. non-conductive base means, carried by said outer enclosure, for sealingly housing said piston, said piston and said base means defining a gas-filled variable volume chamber which is pressurized when said prime mover moves said second electrical contact from its closed position to its opened position;

h. lost motion means, carried by said first electrical contact, for holding said first and second electrical contacts together until said piston is separated from said contactor means when said prime mover strokes said second electrical contact to a position intermediate its opened and closed positions; and i. insulated plenum means, carried by said piston and in fluid communication with said orifice, for channeling the pressurized gas within said variable volume chamber around the abutting ends of said first and second electrical contacts and for channeling said pressurized gas into said gap and into the interior of said at least one electrical contact, said plenum means having an axial length greater than the length of the arc formed across said gap when said first and second electrical contacts are separated, whereby those portions of said enclosure radially disposed relative to said gap are shielded from the ionized fluid produced by said arc.

3. The interrupter set forth in claim 2, wherein said first and second electrical contacts are tubular members having complementary abutting ends which are co-axially disposed relative to each other such that when said second electrical contact is in its closed position fluid communication from the exterior to the interior of said tubular members is shut-off across said abutting ends.

4. The interrupter set forth in claim 2, wherein said base means carries a check valve, said check valve being disposed between said variable volume chamber and the interior of said outer enclosure to pass flow from said outer enclosure into said variable volume chamber, the pressure developed within said variable volume chamber by the stroking of said piston with said prime mover in moving said second electrical contact to its opened position forcing said check valve shut, and the pressure reduction within said variable volume chamber caused by the stroking of said piston with said prime mover in moving said second electrical contact to its opened position having the effect of opening said check valve, and admitting arc extinguishing gas into said variable volume chamber, thereby replenishing said variable volume chamber with arc extinguishing gas.

5. The interrupter set forth in claim 2, wherein the axial length of said insulated plenum means is at least equal to the distance that said second electrical contact is stroked by said prime mover, whereby said radial portions of said outer enclosure are shielded from said gap after said arc is extinguished.

6. The interrupter set forth in claim 2, wherein said base means defines a cylinder having an open end which adapted to receive said piston, and an axial length greater than the axial length of said plenum means such that said open end extends beyond said plenum means when said second electrical contact is in its open position, whereby said cylinder shields said radial portions of said outer enclosure from the arc formed across said gap.

7. The interrupter set forth in claim 2, wherein said second electrical contact is axially guided within said outer enclosure by said base means.

8. The interrupter set forth in claim 7, wherein said base means includes current interchange means for electrically connecting said second electrical contact to an external electrical circuit.

9. The interrupter set forth in claim 2, wherein said outer enclosure is formed from electrically non-conducting material.

10. The interrupter set forth in claim 2, wherein at least one of said plenum means and said base means is radially disposed between said gap and said radial portions of said outer enclosure throughout the stroke of said second electrical contact.

11. The interrupter set forth in claim 2, wherein said base means includes:

a. a base member carrying a check valve for passing arc extinguishing gas into said variable volume chamber when said second electrical contact is stroked to its closed position, said base member defining an opening adapted to sealingly receive said second electrical contact;

b. a cylinder member connected to said base member, said cylinder member and said base member defining an open ended cylindrical housing adapted to sealingly receive said piston; and c. current interchange means, carried by said base member, for electrically connecting said second electrical contact to an external electrical circuit.

12. The interrupter set forth in claim 2, wherein said piston is disposed at a spaced distance from said one end of said second electrical contact and wherein said piston defines a plurality of flow orifices disposed around said one end of said second electrical contact for communicating the gas within said variable volume chamber around said gap; and wherein said plenum means defines a tubular nozzle, one end of which is connected to said piston and which is disposed around the exterior of said second tubular electrical contact with said flow orifices open to the interior of said tubular nozzle, the other end of said nozzle being disposed adjacent the exterior surface of said first electrical contact when said second tubular contact is in its closed position so as to define a flow restrictive annular opening, whereby fluid discharged from said variable volume chamber by the stroking of said piston forces pressurized arc extinguishing fluid into said gap until said other end of said tubular nozzle passes beyond the abutting end of said first electrical contact.

13. The interrupter set forth in claim 3, wherein said lost motion means includes:

a. a stop carried along the exterior of said first electrical contact;

b. a sleeve carried by said outer enclosure and adapted to receive said first electrical contact, said sleeve defining an axial slot adapted to receive said stop, whereby said first electrical contact is free to move axially between a first and a second position defined by the length of said slot; and c. extensible means, disposed between said first electrical contact and said outer enclosure, for biasing said first electrical contact toward said second electrical contact, said biasing means being compressed by said second electrical contact when said second electrical contact is in its closed position thereby forcing said first tubular contact to a position intermediate its first and second positions.

14. The interrupter set forth in claim 13, wherein said sleeve carries said contactor means, said contactor means including a plurality of axially aligned sliding fingers radially disposed around said first electrical contact and said plenum means, said sliding fingers remaining fixed in their axial position when said second electrical contact is moved towards its opened position, said sliding fingers breaking contact with said piston before said first electrical contact reaches its second position and after said piston leaves it raised position, whereby electrical current flowing through said sliding fingers is shut off before said first and second electrical contacts separate to form said gap without an electrical arc being formed exterior to said plenum means.

15. In a distribution class interrupter, comprising:

a. an outer enclosure adapted to be filled with an arc-extinguishing gas;

b. a first tubular electrical contact defining a stop element at one end, said enclosure carrying at its interior a housing adapted to receive said first electrical contact and defining an axially disposed aperture adapted to receive said stop element, whereby said first tubular electrical contact is free to move between a first position and a second position defined by the extreme ends of said aperture, and extensible means, disposed between said first tubular electrical contact and said housing, for biasing said first tubular electrical contact in said first position;

c. a second tubular electrical contact which is co-axially disposed relative to said first tubular electrical contact and which is movable between a closed position where one of its ends is in an abutting sealing relationship with said first tubular electrical contact and an opened position where said one end is at a spaced distance from said first tubular electrical contact, the abutting ends of said first tubular electrical contact and said second tubular electrical contact defining a gap when said second tubular electrical contact is in its opened position and said first tubular electrical contact is in its first position;

d. a prime mover for moving said second electrical contact between its opened and closed positions, said biasing means being compressed by said second tubular electrical contact when said second tubular electrical contact is in its closed position so as to force said first tubular electrical contact to a position intermediate its first and second positions;

e. electrically conductive piston means, carried by said second tubular electrical contact, for ducting fluid towards said one end of said second tubular electrical contact, said piston means defining a plurality of flow orifices disposed around said one end of said second tubular electrical contact;

f. contactor means, carried by said first housing and mating with said piston means, for conducting electrical current from said first tubular electrical contact to said second tubular electrical contact when said second tubular electrical contact is in its closed position, said contactor means including a plurality of sliding fingers radially disposed around the axis of said first and said second tubular electrical contacts, each of said sliding fingers defining a free end which is axially positioned intermediate the axial positions of the abutting end of said first tubular electrical contact when said first tubular electrical contact is in its first and second positions, whereby the free end of said sliding fingers breaks contact with said piston means before said first tubular electrical contact reaches its second position and current flow through said sliding fingers is shut off before said first and second tubular electrical contacts separate to form said gap;

g. non-conductive base means, carried by said outer enclosure, for housing said piston, said base means including a base member having an opening adapted to sealingly receive said second tubular electrical contact, a cylinder member connected to said base means to sealingly receive said piston means, said cylinder member and said base member together with said second tubular electrical contact defining a gas-filled variable volume chamber which is pressurized when said prime mover strokes said second tubular electrical contact from its closed positioned to its open position, a check valve for passing arc-extinguishing gas into said variable volume chamber when said second tubular electrical contact is moved to its closed position, and current interchange means for electrically connecting said second tubular electrical contact to an external electrical circuit, whereby the stroking of said second tubular electrical contact by said prime mover to its open position has the effect of opening said check valve and admitting arc-extinguishing gas into said variable volume chamber to replenish the gas discharged therefrom when said second tubular electrical contact is stroked to its closed position; and h. insulated plenum means, carried by said piston means and radially disposed between said sliding fingers and said first and second tubular electrical contacts, for restricting the flow of gas out of said variable volume chamber and for channeling gas from said variable volume chamber into the interior of said first and second tubular electrical contacts when said second tubular electrical contact is moved from its closed position to its opened position, said insulated plenum means defining a generally cylindrical tube having a length at least equal to the axial length of said cylinder member and greater than the length of the arc produced across said gap, and having one end connected to said piston means at a spaced distance from the exterior of said second tubular electrical contact such that said flow orifices are disposed between the interior of said tube and the exterior of said second tubular electrical contact, the other end of said tube being disposed closely adjacent the exterior surface of said first tubular electrical contact when said second tubular electrical contact is in its closed position, whereby gas discharged from said variable volume chamber by the stroking of said piston means is forced under pressure around the exterior of the abutting ends and into the interior of said first and said second tubular electrical contacts until said first tubular contact element is in its first position and until the other end of said tube passes beyond the abutting end of said first tubular electrical contact, and the interior of said outer enclosure and the free end of said fingers are shielded from the ionized fluid produced by said arc.

* * * * *